US005696545A

United States Patent [19]

Ochiai et al.

[11] Patent Number: 5,696,545

[45] Date of Patent: Dec. 9, 1997

[54] INK JET PRINTER HEAD

[75] Inventors: Kuniaki Ochiai; Shigeo Komakine, both of Mishima, Japan

[73] Assignee: Kabushiki Kaisha TEC, Shizuoka, Japan

[21] Appl. No.: 417,786

[22] Filed: Apr. 6, 1995

[30] Foreign Application Priority Data

Apr. 7, 1994 [JP] Japan ..... 6-69186

[51] Int. Cl.[6] ..... B41J 2/045

[52] U.S. Cl. ..... 347/71; 347/69; 310/333

[58] Field of Search ..... 347/69, 71, 20, 347/54, 68; 310/328, 330, 333, 345

[56] References Cited

U.S. PATENT DOCUMENTS

| | | | |
|---|---|---|---|
| 4,879,568 | 11/1989 | Bartky | 347/69 |
| 5,016,028 | 5/1991 | Temple | 347/69 |
| 5,193,256 | 3/1993 | Ochiai et al. | 29/25.35 |
| 5,248,998 | 9/1993 | Ochiai et al. | 347/71 |
| 5,301,404 | 4/1994 | Ochiai et al. | 29/25.35 |
| 5,311,218 | 5/1994 | Ochiai et al. | 347/71 |
| 5,311,219 | 5/1994 | Ochiai et al. | 347/71 |
| 5,327,627 | 7/1994 | Ochiai et al. | 29/25.35 |
| 5,351,375 | 10/1994 | Ochiai et al. | 29/25.35 |
| 5,459,501 | 10/1995 | Lee et al. | 347/68 |
| 5,512,796 | 4/1996 | Paton | 347/68 X |

FOREIGN PATENT DOCUMENTS

| | | |
|---|---|---|
| 0 533 506 | 3/1993 | European Pat. Off. . |
| 0 565 280 | 10/1993 | European Pat. Off. . |
| 0 639 460 | 2/1995 | European Pat. Off. . |
| WO 92/09436 | 6/1992 | WIPO . |

*Primary Examiner*—Benjamin R. Fuller
*Assistant Examiner*—Charlene Dickens
*Attorney, Agent, or Firm*—Oblon, Spivak, McClelland, Maier & Neustadt, P.C.

[57] ABSTRACT

Disclosed herein is an ink jet printer head including a substrate which includes a piezoelectric member polarized across a thickness thereof and a plate-like low-rigid member bonded to an upper surface of the piezoelectric member. The low-rigid member has a low permittivity and a rigidity lower than that of the piezoelectric member. The substrate has a plurality of grooves cut from an upper surface of the low-rigid member to a depth beyond a bonded surface between the low-rigid member and the piezoelectric member. A top plate is bonded to the upper surface of the low-rigid member so as to cover upper openings of the grooves, thereby defining a plurality of pressure chambers between the grooves and the top plate. A plurality of ink jet nozzles are provided so as to respectively communicate with the pressure chambers. A plurality of electrodes are formed on inner surfaces of the pressure chambers. A plurality of wiring patterns are formed on the upper surface of the low-rigid member and connected to the electrodes.

16 Claims, 6 Drawing Sheets

INK JET PRINTER HEAD

BACKGROUND OF THE INVENTION

1. Field of the Invention

The present invention relates to an on-demand type of ink jet printer head adapted to be mounted on an ink jet printer and more particularly to an ink jet printer head for jetting ink in the form of droplets from ink jet nozzles by deforming pressure chambers for holding the ink.

2. Description of the Prior Art

A conventional ink jet printer head is known from the invention disclosed in Japanese Patent Laid-open No. 2-150355 (corresponding to U.S. Pat. No. 5,016,028). Such a conventional ink jet printer head will now be described with reference to FIGS. 6A to 6D. FIGS. 6 and 6B how fragmentary sectional views of a bottom sheet 40 forming a part of the ink jet printer head. The bottom sheet 40 is formed from a piezoelectric member polarized in the direction shown by arrows 41. The bottom sheet 40 has a plurality parallel grooves 42, shallow grooves 43 respectively contiguous to the grooves 42 and side walls each formed between adjacent one of the grooves 42. As shown in FIG. 6C, a top sheet 45 is bonded to the upper end surfaces of the side walls 44 by means of adhesive 50, and a plate 47 having a plurality of orifices 46 respectively communicating with the grooves 42 is fixed to the front end surfaces of the side walls 44. A pair of electrodes 48 are formed on the opposed inner side surfaces of each groove 42 each at substantially upper half portion thereof, and a wiring pattern 49 for applying voltage to the electrodes 48 is formed on the whole inner surface of each shallow groove 43. Each electrode 48 and each wiring pattern 49 are formed by vapor deposition.

In operation, as shown in FIG. 6D, voltage is applied to the electrodes 48*a* in a central pressure chamber (groove 42*a*), and the electrodes 48*b* and 48*c* in two pressure chambers (grooves 42*b* and 42*c*) adjacent to the central pressure chamber are grounded. As a result, the side walls 44 on both sides of the central pressure chamber undergoes a shearing strain as shown by broken lines, causing a decrease in volume of the central pressure chamber (groove 42*a*). Accordingly, the pressure of ink in the central pressure chamber is increased to jet the ink in the form of droplets from the corresponding orifice 46.

However, the invention disclosed in Japanese Patent Laid-open No. 2-150355 has the following two problems. The first problem is that the strain (displacement) of the side walls 44 cannot be increased. More specifically, while voltage is applied to the electrodes 48*a* formed on the upper half portions of the side walls 44 (i.e., the upper half portions of the inner side surfaces of the groove 42*a*), so as to deform the side walls 44, a shearing force generated at the upper half portions of the side walls 44 (the portions on which the electrodes 48*a* are formed) is received by the lower half portions of the side walls 44 (the portions on which the electrodes 48*a* are not formed). In other words, the lower half portions themselves of the side walls 44 generate no shearing force, but they resist the strain of the upper half portions of the side walls 44. As both the upper half portions and the lower half portions of the side walls 44 are formed from the piezoelectric member having a greatly high rigidity, the strain of the side walls 44 cannot be increased. As a result, a change in volume of each pressure chamber (each groove 42) is small, causing lowering of ink jet characteristics.

The second problem is that a power consumption in driving the ink jet printer head is high and that an operating speed of the side walls 44 upon compressing the ink cannot be increased. In the structure disclosed in the above-mentioned prior art, the wiring patterns 49 connected to the electrodes 48 are provided on the piezoelectric member (bottom sheet 40) having a high specific permittivity, and the spacing between adjacent ones of the wiring patterns 49 is small. Accordingly, an electrostatic capacity between the wiring patterns 49 is large, which causes an increase in electric current flowing through the wiring patterns 49 upon application of voltage thereto and an increase in power consumption in driving the ink jet printer head. Further, the time period from the instance of application of voltage to the electrodes 48 to the instance the applied voltage reaches a given voltage becomes long. As a result, the operating speed of the side walls 44 in compressing the ink cannot be increased.

SUMMARY OF THE INVENTION

It is a first object of the present invention to increase the amount of deformation of the side walls forming the pressure chambers, thereby improving the ink jet characteristics.

It is a second object of the present invention to improve the operation response of the side walls forming the pressure chambers to realize a higher printing speed.

It is a third object of the present invention to reduce a power consumption during operation.

It is a fourth object of the present invention to facilitate the manufacturing of the ink jet printer head.

It is a fifth object of the present invention to increase the strength of the ink jet printer head in structure.

According to an aspect of the present invention, there is provided an ink jet printer head comprising a substrate comprising a piezoelectric member polarized across a thickness thereof and a plate-like low-rigid member bonded to an upper surface of the piezoelectric member, the low-rigid member having a low permittivity and a rigidity lower than that of the piezoelectric member; the substrate having a plurality of grooves cut from an upper surface of the low-rigid member to a depth beyond a bonded surface between the low-rigid member and the piezoelectric member; a top plate bonded to the upper surface of the low-rigid member so as to cover upper openings of the grooves, thereby defining a plurality of pressure chambers between the grooves and the top plate; a plurality of ink jet nozzles respectively communicating with the pressure chambers; a plurality of electrodes formed on inner surfaces of the pressure chambers; and a plurality of wiring patterns formed on the upper surface of the low-rigid member and connected to the electrodes. In operation, when voltage is applied to the electrodes, side walls forming the pressure chambers are deformed to reduce the volume of the pressure chambers, during which the pressure in the pressure chambers is increased to thereby jet the ink from the ink jet nozzles. A lower part of each side wall is formed from the piezoelectric member having a high rigidity, whereas a remaining upper part of each side wall is formed from the low-rigid member having a rigidity lower than that of the piezoelectric member. Accordingly, a resistance of the upper part of each side wall formed from the low-rigid member against strain of the lower part of each side wall formed from the piezoelectric member can be reduced to thereby increase the strain of each side wall as a whole. As a result, the ink jet characteristics can be improved. Further, the wiring patterns for applying voltage to the electrodes are formed on the low-rigid member having a low permittivity. Accordingly, an electrostatic capacity between the wiring patterns can be greatly reduced.

As a result, an electric current flowing through the wiring patterns to which voltage has been applied can be reduced to thereby reduce a power consumption. Further, the time period from the instance of application of voltage to the electrodes to the instance the voltage applied to the electrodes reaches a given voltage can be shortened to thereby improve the operation response of the side walls and allow a quick rise of pressure of the ink in the pressure chambers, thus realizing high-speed printing.

According to another aspect of the present invention, there is provided an ink jet printer head comprising a bottom plate as a structure foundation; a plurality of side walls projecting from an upper surface of the bottom plate and spaced a given distance from each other, each of the side walls comprising a lower side wall and an upper side wall connected to an upper end of the lower side walls, the lower side wall being formed from a piezoelectric member polarized in one direction, the upper side wall being formed from a low-rigid member having a low permittivity and a rigidity lower than that of the lower side wall; a top plate for covering upper ends of the side walls to define a plurality of pressure chambers each between adjacent ones of the plural side walls; a plurality of ink jet nozzles respectively communicating with front ends of the pressure chambers; a wiring pattern forming surface formed from the low-rigid member, the wiring pattern forming surface being contiguous to rear ends of the pressure chambers and upper ends of the side walls; a plurality of electrodes formed on inner surfaces of the pressure chambers; and a plurality of wiring patterns formed on the wiring pattern forming surface and connected to the electrodes. In operation, when voltage is applied to the electrodes, side walls forming the pressure chambers are deformed to reduce the volume of the pressure chambers, during which the pressure in the pressure chambers is increased to thereby jet the ink from the ink jet nozzles.

According to a further aspect of the present invention, there is provided an ink jet printer head comprising a substrate having a plurality of pressure chambers regularly arranged for receiving a supply of ink and holding the ink supplied; a plurality of ink jet nozzles respectively communicating with front ends of the pressure chambers; a plurality of side walls for forming side surfaces of the pressure chambers, each of the side walls comprising a lower side wall and an upper side wall connected to an upper end of the lower side wall, the lower side wall being formed from a piezoelectric member polarized in one direction, the upper side wall being formed from a low-rigid member having a low permittivity and a rigidity lower than that of the lower side wall; a wiring pattern forming surface formed from the low-rigid member, the wiring pattern forming surface being contiguous to rear ends of the pressure chambers and upper ends of the side walls; a plurality of electrodes formed on inner surfaces of the pressure chambers; and a plurality of wiring patterns formed on the wiring pattern forming surface and connected to the electrodes. In operation, when voltage is applied to the electrodes, side walls forming the pressure chambers are deformed to reduce the volume of the pressure chambers, during which the pressure in the pressure chambers is increased to thereby jet the ink from the ink jet nozzles.

Other objects and features of the invention will be more fully understood from the following detailed description and appended claims when taken with the accompanying drawings.

DETAILED DESCRIPTION OF TEE PREFERRED EMBODIMENTS

A first preferred embodiment of the present invention will now be described with reference to FIGS. 1 to 4C. The structure of an ink jet printer head according to the first preferred embodiment will first be described with reference to FIGS. 2A to 4C in the order of the manufacturing steps of the ink jet printer head. As shown in FIG. 2A, a substrate 20 is first manufactured. More specifically, a fluidic resin to be formed into a low-rigid member 22 having a rigidity lower than that of a plate-like piezoelectric member 21 is applied over the upper surface of the piezoelectric member 21. The piezoelectric member 21 is formed from a lead zirconate titanate piezoelectric ceramic plate polarized across the thickness thereof. The fluidic resin used herein is a two-liquid mixing type of epoxy adhesive containing an inorganic filler in consideration of an adhesive strength, ease of after-treatment, adhesion of plating in forming electrodes, coefficient of linear expansion, etc. The epoxy adhesive is applied to the piezoelectric member 21 over the upper surface thereof so that no bubbles are left in the coating of the epoxy adhesive. Then, the coating of the epoxy adhesive is cured to thereby form the low-rigid member 22 fixed to the upper surface of the piezoelectric member 21.

Figure 2A:
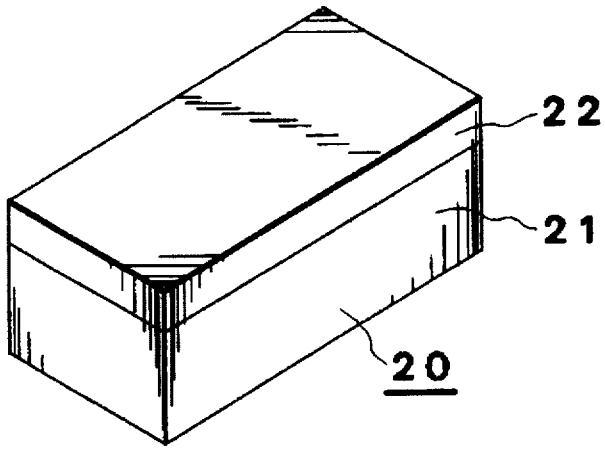
FIG. 2A is a perspective view of a substrate in the first step of manufacturing of the ink jet printer head.
Figure 2B:
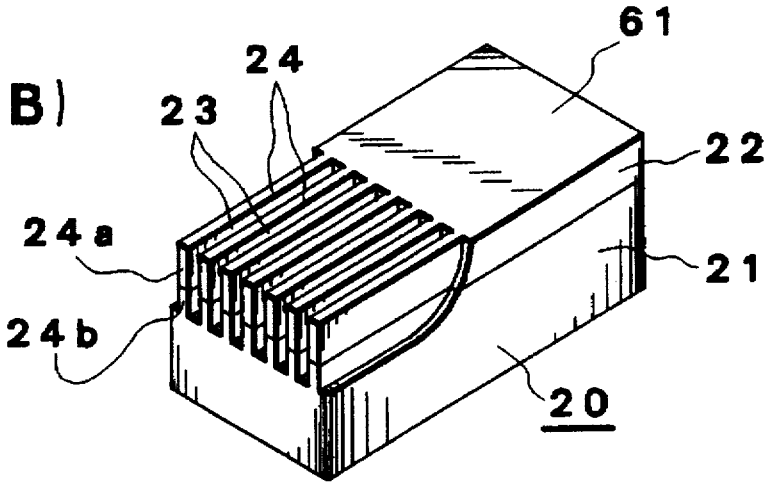
FIG. 2B is a perspective view of the substrate in which grooves have been formed, showing the step next to FIG. 2A.

In the next step, the upper surface of the low-rigid member 22 is ground to a flat surface with reference to the upper surface of the piezoelectric member 21. Then, as shown in FIG. 2B, the substrate 20 is cut from the upper surface of the low-rigid member 22 with a depth beyond the bonded surface between the low-rigid member 22 and the piezoelectric member 21 to form a plurality of grooves 23 spaced a given distance from each other. The formation of the plural grooves 23 results in formation of a plurality of side walls 24, any adjacent ones of which are formed on the opposed sides of each groove 23. Each side wall 24 include an upper side wall 24*a* formed from the low-rigid member 22 and a lower side wall 24*b* formed from the piezoelectric member 21. This cutting of the substrate 20 is performed by using a diamond wheel for use in cutting of an IC wafer. Each groove 23 is formed so that one longitudinal end thereof is opened to one longitudinal end surface of the substrate 20 and that the other longitudinal end is not opened to the other end surface of the substrate 20. Accordingly, a part of the upper surface of the substrate 20 on the closed side of the grooves 23 is left as a flat surface. This flat portion of the substrate 20 is formed as a wiring pattern forming surface 61 on which a plurality of wiring patterns 29 are to be formed as will be hereinafter described.

In the next step, washing, catalyzing, and accelerating are performed as a pretreatment of formation of electrodes by electroless plating. The washing is performed for the purposes of activating a plating forming surface and making the surface of the substrate 20 hydrophilic to facilitate entry of a catalyst liquid, accelerator liquid, and plating liquid into the grooves 23. The catalyzing is next performed for the purpose of adsorbing a complex of Pd and Sn on the inner surface of each groove 23 by immersing the substrate 20 into the catalyst liquid as a pretreatment liquid containing palladium chloride, stannous chloride, and concentrated sulfuric acid. The catalyzing allows the complex of Pd and Sn to be adsorbed on the surface of the low-rigid member 22 and the inner surface of each groove 23 formed by the upper side wall 24*a* and the lower side wall 24*b*. The accelerating is next performed for the purpose of making the complex adsorbed in the catalyzing process into a catalyst, so that the complex adsorbed on the side walls 24, etc. is made into metallized Pd as a catalyst core.

Figure 2C:
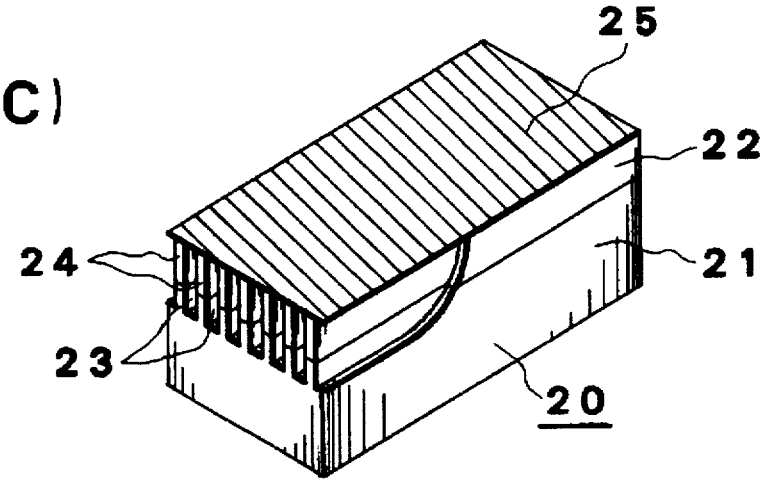
FIG. 2C is a perspective view of the substrate on which a dry film has been attached, showing the step next to FIG. 2B.
Figure 3A:
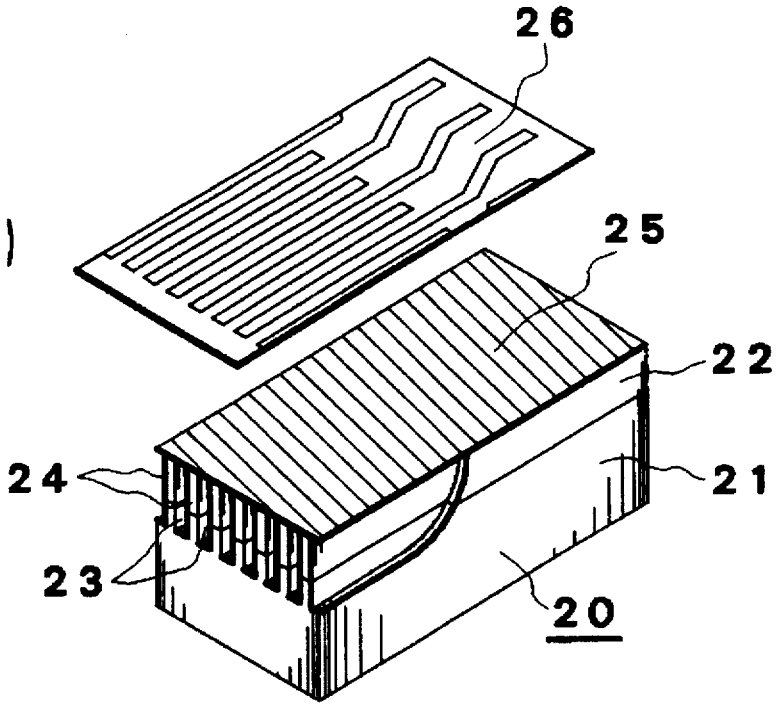
FIG. 3A is a perspective view of the substrate wherein a resist mask is to be placed on the dry film, showing the step next to FIG. 2C.
Figure 3B:
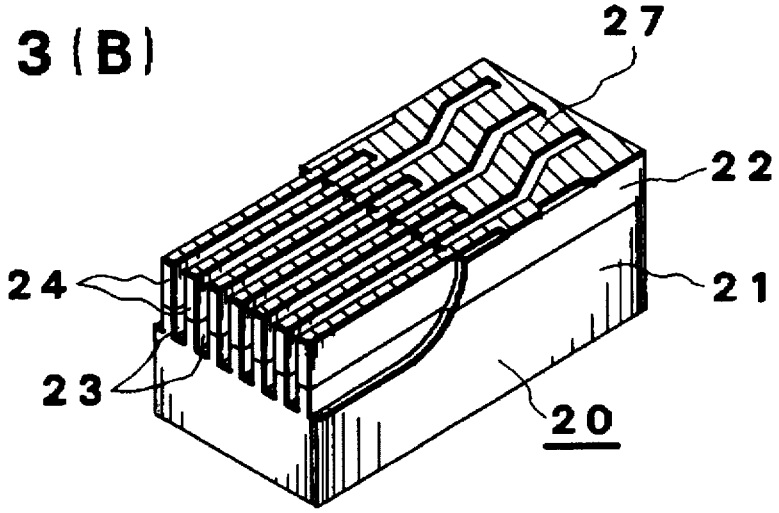
FIG. 3B is a perspective view of the substrate wherein a resist film has been formed from the dry film, showing the step next to FIG. 3A.

In the next step, a mask is formed on the upper surface of the low-rigid member 22 except a wiring pattern forming portion. More specifically, as shown in FIG. 2C, a dry film 25 is attached to the upper surface of the low-rigid member 22. Then, as shown in FIG. 3A, a resist mask 26 is placed on the dry film 25. In this condition, exposure and development are performed to the dry film 25. Accordingly, as shown in FIG. 3B, a resist film 27 is formed from the dry film 25 on the upper surface of the low-rigid member 22 except the wiring pattern forming portion. In this condition, the metallized Pd is exposed from the wiring pattern forming portion of the low-rigid member 22 and the inner surface of each groove 23.

Figure 4A:
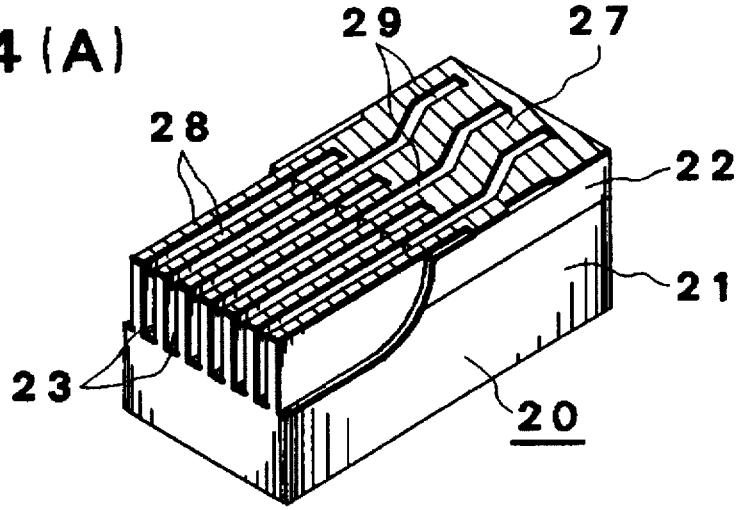
FIG. 4A is a perspective view of the substrate wherein electrodes have been formed in the grooves, showing the step next to FIG. 3B.

In the next step, the substrate 20 is immersed into the plating liquid to perform electroless plating. The plating liquid is composed of a main component containing a metal salt and a reducing agent and an auxiliary component containing a pH adjusting agent, a buffering agent, a complexing agent, an accelerating agent, a stabilizing agent, and a modifying agent. The substrate 20 as a bonded body (a subject body to be plated) formed by bonding the piezoelectric member 21 and the low-rigid member 22 is immersed into the plating liquid to form a plating with the metallized Pd functioning as a catalyst core. Accordingly, as shown in FIG. 4A, a plurality of electrodes 28 are formed on the inner side surfaces of the grooves 23, i.e., the side surfaces of the side walls 24, and the bottom surfaces of the grooves 23. Further, a plurality of wiring patterns 29 contiguous to the electrodes 28 are also formed on the upper surface of the low-rigid member 22, i.e., on the wiring pattern forming surface 61.

Figure 4B:
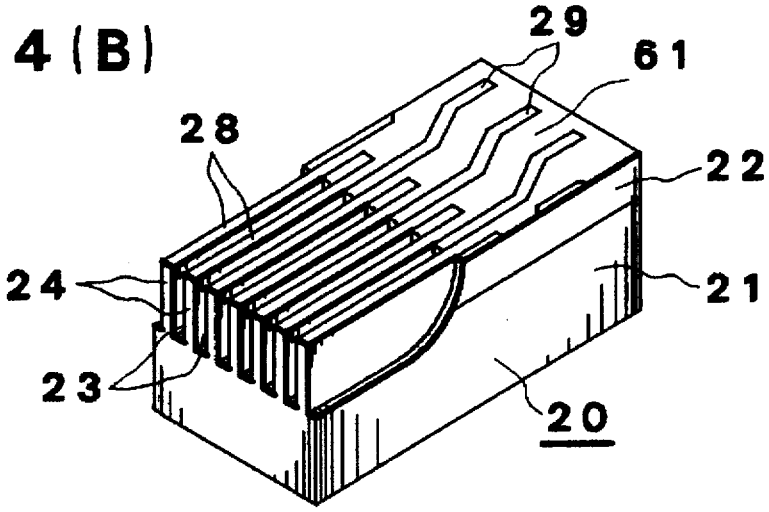
FIG. 4B is a perspective view of the substrate from which the resist film has been removed, showing the step next to FIG. 4A.
Figure 4C:
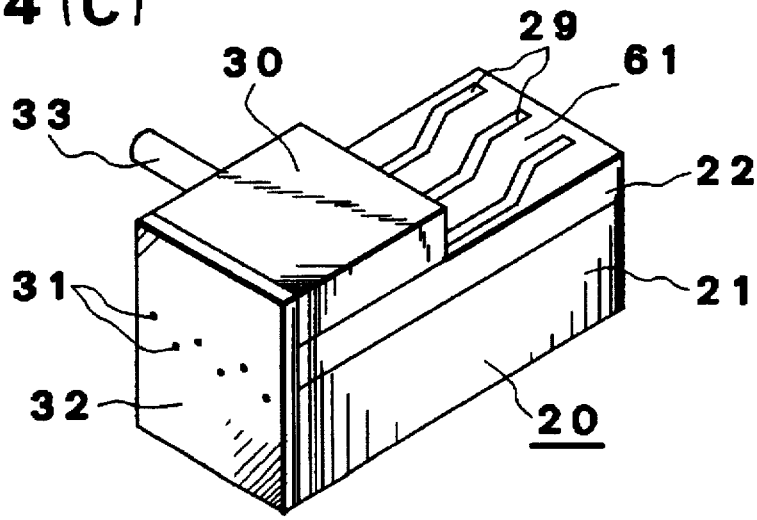
FIG. 4C is a perspective view of the ink jet printer head completed by mounting a top plate and a nozzle plate on the substrate and mounting an ink supply pipe to the top plate, showing the step next to FIG. 4B.

In the next step, the resist film 27 attached to the upper surface of the low-rigid member 22 is separated off as shown in FIG. 4B. Then, as shown in FIG. 4C, a top plate 30 is bonded to the upper surface of the low-rigid member 22. In this condition, all the grooves 23 are closed at their upper openings to define a plurality of pressure chambers 34 (see FIG. 1). In bonding the top plate 30 to the upper surface of the low-rigid member 22, there occurs a step at the boundary between the front end surface of the substrate 20 and the front end surface of the top plate 30. Accordingly, this step is removed by grinding both the front end surfaces of the substrate 20 and the top plate 30. Thereafter, a nozzle plate 32 having a plurality of ink jet nozzles 31 respectively communicating with the front end openings of the grooves 23 is fixed to both the flushed front end surfaces of the substrate 20 and the top plate 30. Then, an ink supply pipe 33 as an ink supply member for supplying ink from an ink supply passage (not shown) to each groove 23 is mounted to the top plate 30, thereby completing the ink jet printer head.

Figure 1:
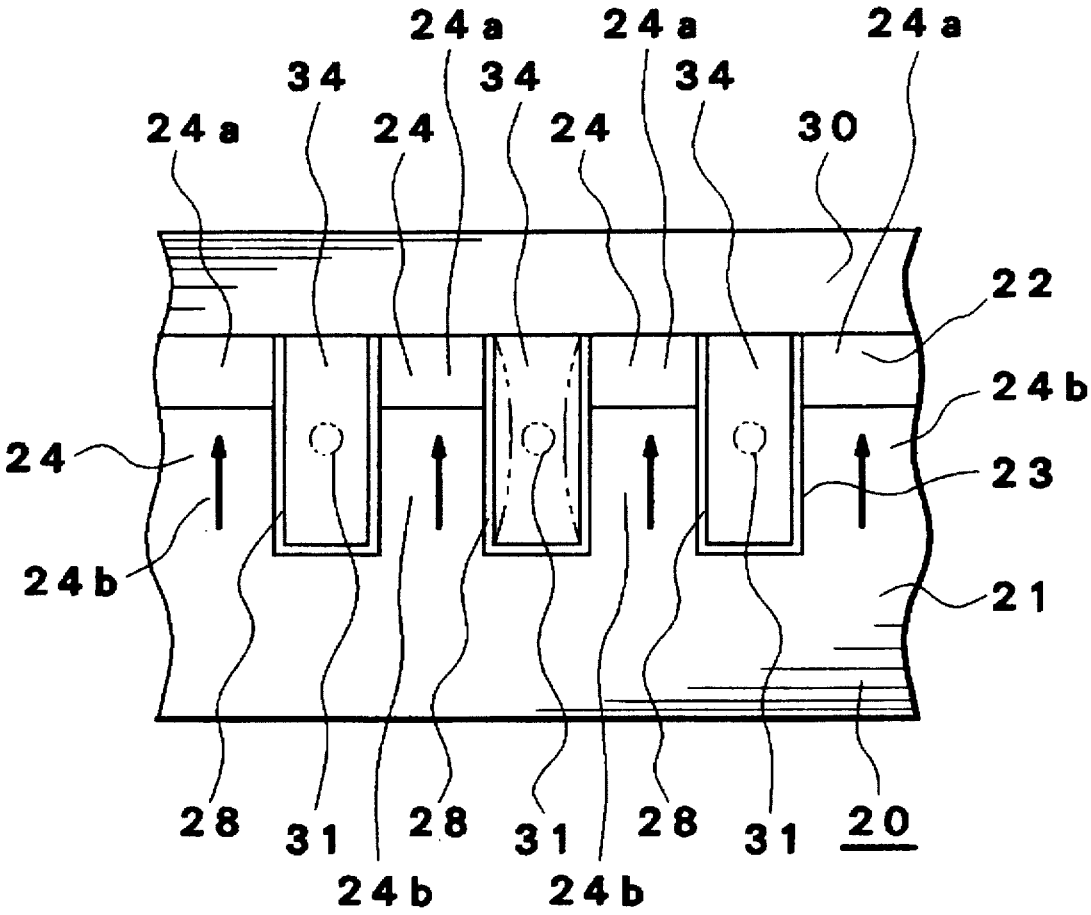
FIG. 1 is a front elevational view of an ink jet printer head in the condition where a nozzle plate is removed according to a first preferred embodiment of the present invention.

FIG. 1 shows a front elevational view of the ink jet printer head thus manufactured in the condition where the nozzle plate 32 is removed. In FIG. 1, arrows show a direction of polarization of the piezoelectric member 21. Electric fields are applied both to the electrodes 28 in the pressure chamber 34 from which the ink is intended to be jetted and to the electrodes 28 in the two pressure chambers 34 formed adjacent to the intended pressure chamber 34. Accordingly, the two side walls 24 adjacent to the intended pressure chamber 34 are symmetrically displaced to thereby suck or jet the ink.

In FIG. 1, phantom lines shown in the central pressure chamber 34 indicate a condition that the two side walls 24 adjacent to the central pressure chamber 34 are inwardly deformed, so as to increase the pressure in the central pressure chamber 34 and thereby jet the ink therefrom. As an upper part of each side wall 34 is formed as the upper side wall 24*a* formed from the low-rigid member 22, the resistance of the upper side wall 24*a* against the operation of the lower side wall 24*b* formed from the piezoelectric member 21 can be reduced to thereby allow large operation of each side wall 24 as a whole. Furthermore, as the wiring patterns 29 of the ink jet printer head manufactured above are provided on the low-rigid member 22 having a low permittivity (having a specific permittivity of 3.8 to 4.7 in this preferred embodiment), the electrostatic capacity between the wiring patterns 29 can be greatly reduced as compared with the conventional structure that the wiring patterns are provided on the piezoelectric member (having a specific permittivity of 1500 to 4700). Accordingly, in applying voltage across the electrodes 28 in the pressure chamber 34, electric current flowing through the electrodes 28 can be reduced, and the time period from the instance of application of voltage to the electrodes 28 to the instance the voltage applied to the electrodes 28 reaches a given voltage can be shortened. Owing to these advantages, the ink jet characteristics of the ink jet printer head can be improved.

Although the low-rigid member 22 is formed of adhesive in this preferred embodiment, the material of the low-rigid member 22 is not limited to adhesive. For example, a molded plate formed of a resin material may be used for the low-rigid member 22. Also in this case, the objects of the present invention can be attained. Further, although the electrodes 28 and the wiring patterns 29 are formed by electroless plating in this preferred embodiment, the forming method for the electrodes 28 and the wiring patterns 29 is not limited to electroless plating. For example, the electrodes 28 and the wiring patterns 29 may be formed by vapor deposition.

Figure 5:
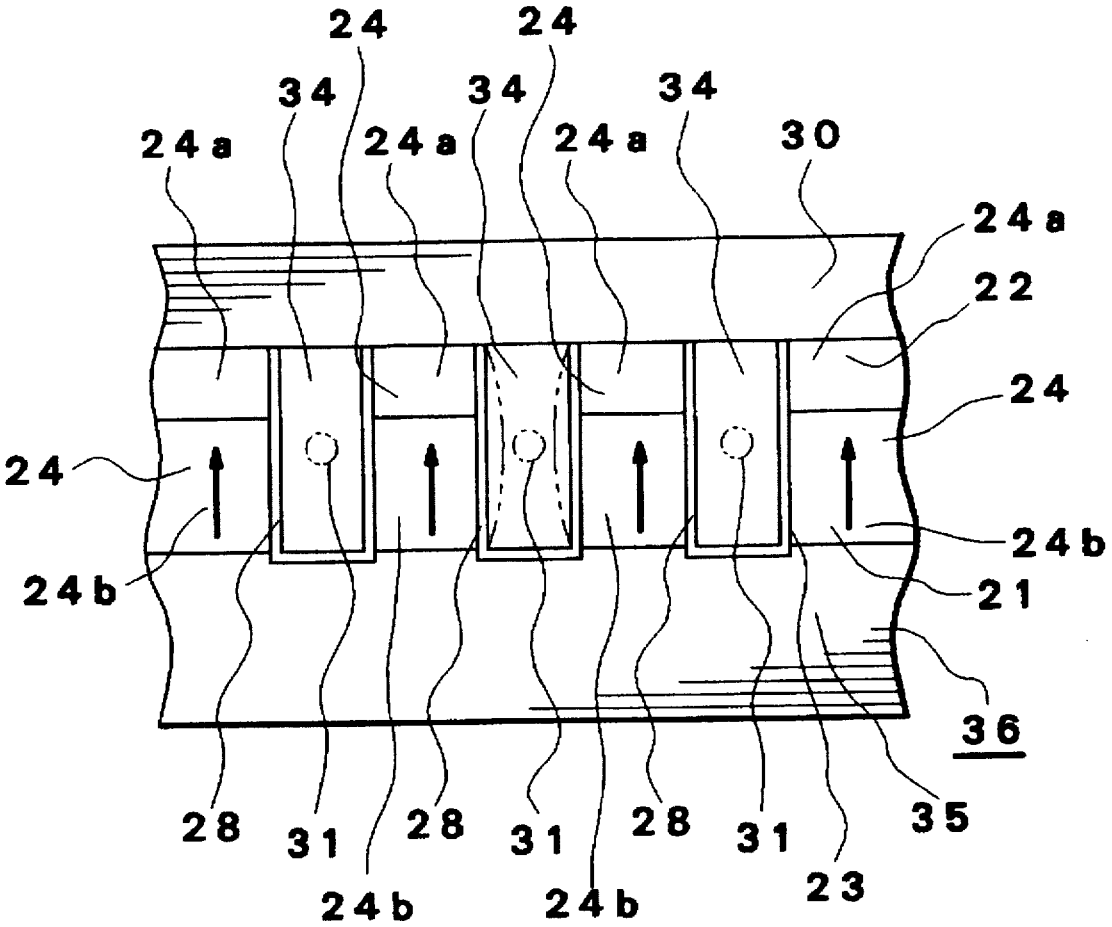
FIG. 5 is a view similar to FIG. 1, showing a second preferred embodiment of the present invention.
Figure 6A:
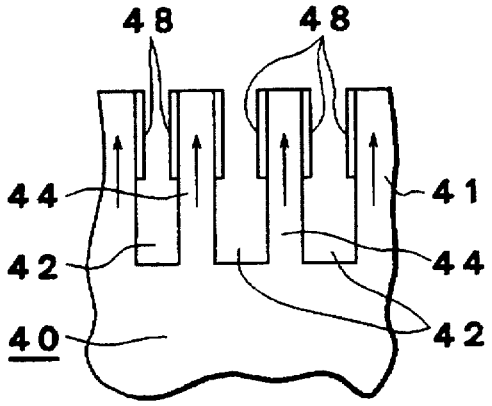
FIG. 6(A) (PRIOR ART)
FIG. 6A is a sectional front elevation of a bottom sheet forming a part of an ink jet printer head in the prior art.
Figure 6B:
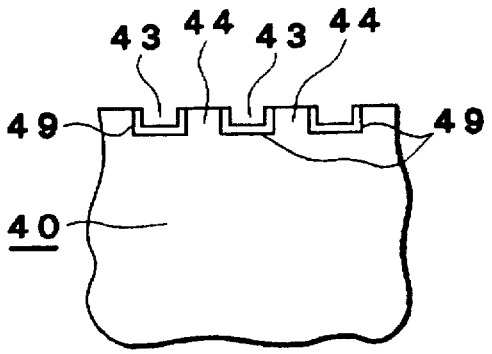
FIG. 6(B) (PRIOR ART)
FIG. 6B is a view similar to FIG. 6A, sectioned at a different position.
Figure 6C:
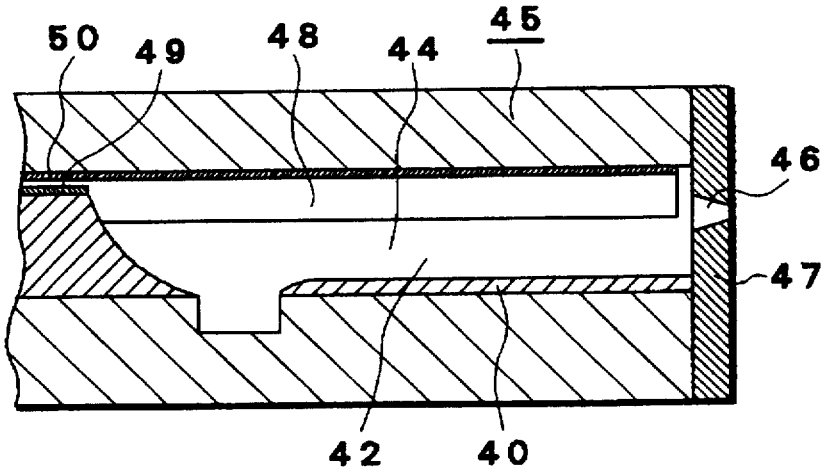
FIG. 6(C) (PRIOR ART)
FIG. 6C is a sectional side elevation of the ink jet printer head including the bottom sheet shown in FIGS. 6A and 6B.
Figure 6D:
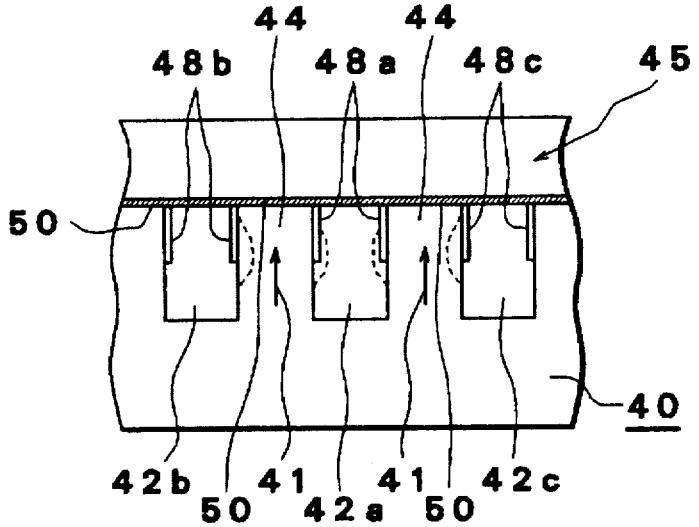
FIG. 6(D) (PRIOR ART)
FIG. 6D is a front elevation of the ink jet printer head shown in FIG. 6C with a nozzle plate omitted.

A second preferred embodiment of the present invention is shown in FIG. 5. The same parts as those in the first preferred embodiment are denoted by the same reference numerals. In this preferred embodiment, reference numeral 36 denotes a substrate composed of a bottom plate 35 formed of a material having a high rigidity and a low thermal deformability, such as ceramics or glass, a piezoelectric member 21 fixed to the upper surface of the bottom plate 35, and a low-rigid member 22 fixed to the upper surface of the piezoelectric member 21. This structure is intended to increase the strength of the ink jet printer head. The other construction including pressure chambers 34, electrodes 28, and wiring patterns 29 is similar to that in the first preferred embodiment, and the description thereof will be omitted herein.

In the second preferred embodiment, grooves 23 defining the pressure chambers 34 are formed with a depth reaching the upper surface of the bottom plate 35. Accordingly, the grooves 23 can be easily formed to have a uniform depth. Alternatively, the depth of each groove 23 may be set so as not to reach the upper surface of the bottom plate 35. Also with this structure, the effect of increasing the strength of the ink jet printer head can be retained.

Having thus described specific preferred embodiments of the present invention, it is to be noted that these preferred embodiments are merely illustrative and are intended not to limit the present invention. The scope of the present invention is not to be construed as identical with that of the above preferred embodiments. Actually, various modifications may be made within the scope of the present invention as defined in the appended claims.

What is claimed is:

1. An ink jet printer head comprising:

a substrate comprising a piezoelectric member having an upper surface and a lower surface and said piezoelectric member being polarized across a thickness thereof and a plate-like low-rigid member bonded to an upper surface of said piezoelectric member, said low-rigid member having an upper surface, a low permittivity and a rigidity lower than a rigidity of said piezoelectric member;

said substrate having a front end surface and a plurality of grooves extending from said upper surface of said low-rigid member to a depth beyond a boundary of said low-rigid member and said piezoelectric member said grooves having upper openings and front end openings;

a top plate bonded to said upper surface of said low-rigid member so as to cover said upper openings of said grooves, said top plate defining a plurality of pressure chambers together with said grooves;

a plurality of ink jet nozzles respectively communicating with said pressure chambers said pressure chambers each having inner surfaces;

a plurality of electrodes formed on said inner surfaces of said pressure chambers; and a plurality of wiring patterns formed on said upper surface of said low-rigid member and connected to said electrodes.

2. An ink jet printer head as recited in claim 1, wherein said substrate further comprises a bottom plate bonded to said lower surface of said piezoelectric member.

3. An ink jet printer head as recited in claim 2, wherein said bottom plate is formed of a material having a high rigidity and a low thermal deformability.

4. An ink jet printer head as recited in claim 2, wherein said piezoelectric member has a bonded surface and said depth of said grooves reaches said bonded surface between said piezoelectric member and said bottom plate.

5. An ink jet printer head as recited in claim 1, wherein said low-rigid member is formed by curing a fluidic resin applied to said upper surface of said piezoelectric member.

6. An ink jet printer head as recited in claim 5, wherein said fluidic resin comprises a two-liquid mixing type of epoxy adhesive containing an inorganic filler.

7. An ink jet printer head as recited in claim 1, further comprising a nozzle plate having said ink jet nozzles, said nozzle plate being bonded to said front end surface of said substrate so that said ink jet nozzles respectively communicate with said front end openings of said grooves.

8. An ink jet printer head as recited in claim 1, wherein said electrodes are formed by electroless plating.

9. An ink jet printer head comprising:

a bottom plate as a structure foundation;

a plurality of side walls projecting from an upper surface of said bottom plate and spaced a given distance from each other, each of said side walls comprising a lower side wall and an upper side wall connected to an upper end of said lower side walls, said lower side wall being formed from a piezoelectric member polarized in one direction, said upper side wall being formed from a low-rigid member having a low permittivity and a rigidity lower than that of said lower side wall;

a top plate for covering upper ends of said side walls to define a plurality of pressure chambers each between adjacent ones of said plural side walls;

a plurality of ink jet nozzles respectively communicating with front ends of said pressure chambers;

a wiring pattern forming surface formed from said low-rigid member, said wiring pattern forming surface being contiguous to rear ends of said pressure chambers and upper ends of said side walls;

a plurality of electrodes formed on inner surfaces of said pressure chambers; and a plurality of wiring patterns formed on said wiring pattern forming surface and connected to said electrodes.

10. An ink jet printer head as recited in claim 9, wherein said bottom plate is integrally formed with said lower side walls.

11. An ink jet printer head as recited in claim 9, wherein said upper ends of said side walls are flush with said wiring pattern forming surface.

12. An ink jet printer head as recited in claim 11, wherein said side walls are formed by cutting said piezoelectric member and said low-rigid member bonded together from an upper surface of said low-rigid member to a depth beyond a bonded surface between said piezoelectric member and said low-rigid member.

13. An ink jet printer head as recited in claim 11, wherein said top plate extends to said wiring pattern forming surface.

14. An ink jet printer head comprising:

a substrate having a plurality of pressure chambers regularly arranged for receiving a supply of ink and holding said ink supplied;

a plurality of ink jet nozzles respectively communicating with front ends of said pressure chambers;

a plurality of side walls for forming side surfaces of said pressure chambers, each of said side walls comprising a lower side wall and an upper side wall connected to an upper end of said lower side wall, said lower side wall being formed from a piezoelectric member polarized in one direction, said upper side wall being formed from a low-rigid member having a low permittivity and a rigidity lower than that of said lower side wall;

a wiring pattern forming surface formed from said low-rigid member, said wiring pattern forming surface being contiguous to rear ends of said pressure chambers and upper ends of said side walls;

a plurality of electrodes formed on inner surfaces of said pressure chambers; and a plurality of wiring patterns formed on said wiring pattern forming surface and connected to said electrodes.

15. An ink jet printer head as recited in claim 14, wherein said upper ends of said side walls are flush with said wiring pattern forming surface.

16. An ink jet printer head as recited in claim 15, wherein said side walls are formed by cutting said piezoelectric member and said low-rigid member bonded together from an upper surface of said low-rigid member to a depth beyond a bonded surface between said piezoelectric member and said low-rigid member.

* * * * *